United States Patent [19]

Kasting et al.

[11] 4,369,627

[45] Jan. 25, 1983

[54] INTERNAL COMBUSTION ENGINE

[75] Inventors: Edward W. Kasting, Seymour; Richard E. Glasson, Columbus, both of Ind.

[73] Assignee: Cummins Engine Company, Inc., Columbus, Ind.

[21] Appl. No.: 160,004

[22] Filed: Jun. 16, 1980

Related U.S. Application Data

[63] Continuation of Ser. No. 958,532, Nov. 7, 1978, abandoned.

[51] Int. Cl.[3] ..... F02F 1/42

[52] U.S. Cl. ..... 60/605; 123/52 M; 123/193 H

[58] Field of Search ..... 60/597, 598, 605; 123/52 M, 188 M, 193 R, 193 CH, 193 H, 432

[56] References Cited

U.S. PATENT DOCUMENTS

| | | | |
|---|---|---|---|
| 1,416,977 | 5/1922 | Roof | 123/52 M X |
| 2,230,740 | 2/1941 | Birkigt | 123/52 M X |
| 2,257,631 | 9/1941 | Wahlberg | 123/52 M X |
| 2,348,518 | 5/1944 | Birkigt | 60/323 X |
| 2,770,224 | 11/1956 | Ericson | 123/52 M X |
| 3,396,532 | 8/1968 | Munk | 60/605 |
| 3,782,344 | 1/1974 | Schmuck | 123/193 H X |
| 3,824,971 | 7/1974 | Skatsche et al. | 123/193 H X |

FOREIGN PATENT DOCUMENTS

| | | | |
|---|---|---|---|
| 177970 | 3/1954 | Austria | 123/193 H |
| 2110648 | 11/1971 | Fed. Rep. of Germany | 123/193 H |
| 694465 | 7/1953 | United Kingdom | 123/193 H |
| 1002846 | 9/1965 | United Kingdom | 123/193 H |
| 1031571 | 6/1966 | United Kingdom . | |
| 1098997 | 1/1968 | United Kingdom | 123/193 H |

*Primary Examiner*—Michael Koczo

*Attorney, Agent, or Firm*—Merriam, Marshall & Bicknell

[57] ABSTRACT

This disclosure relates to a turbocharged reciprocating piston type of internal combustion engine. The engine includes a block, a head fastened to the upper side of the block, and a rocker housing fastened to the upper side of the head. The head has intake air and exhaust passages formed in it between intake and exhaust openings and intake and exhaust ports of the engine cylinders. The turbocharger is mounted on one side of the engine block, and the exhaust openings are in the head on the same side as the turbocharger. Exhaust manifold ducts connect the exhaust openings with the turbocharger. The intake openings are formed in the upper surface of the head and air intake passages are formed in the rocker housing. An air intake duct and manifold connect the turborcharger with the passages of the housing. The intake air passages of the head are formed and located to provide an advantageous heat transfer relation between the intake air and the surrounding engine ports.

18 Claims, 14 Drawing Figures

INTERNAL COMBUSTION ENGINE

This is a continuation of application Ser. No. 958,532, filed Nov. 7, 1978, now abandoned.

DISCLOSURE

In a conventional diesel engine, the intake and exhaust passages formed in the head of the engine extend to manifolds fastened to opposite sides of the head. When such an engine is turbocharged, the turbocharger is fastened to one side of the engine and an air duct extends from the compressor and over the top of the head to the intake manifold.

Such an arrangement has the disadvantages that the intake air duct across the top of the engine increases the overall engine height, and the length of the duct produces pressure losses.

It is a general object of the present invention to provide an improved internal combustion engine which avoids the foregoing disadvantages, and which also provides improved heat transfer characteristics in the head.

An engine in accordance with the present invention includes a head, a plurality of exhaust passages formed in said head, exhaust openings formed in one side of said head and communicating with said exhaust passages, a plurality of intake air passages formed in said head, intake openings formed in the upper surface of said head and communicating with said air passages, a rocker housing fastened to the upper surface of said head, a plurality of intake air passages formed in said housing, an intake air manifold fastened to said housing on the side of the engine which is adjacent the exhaust openings, said air passages of said housing communicating with said air manifold and with said intake openings of said head.

The following listed patents disclose internal combustion engines but none is considered to disclose the features described and claimed herein:

| Patent No. | Patentee | Date |
|---|---|---|
| U.S. Pat. No. 1,132,256 | E. G. Gunn | 3/16/15 |
| U.S. Pat. No. 3,094,976 | C. H. May | 6/25/63 |
| U.S. Pat. No. 3,500,805 | J. Reisacher | 3/17/70 |
| U.S. Pat. No. 3,973,548 | A. Celli | 8/10/76 |
| Great Britain 839,955 | British Patent | 6/29/60 |

The foregoing and other advantages and features of the present invention will become more apparent from the following detailed description taken in conjunction with the accompanying figures of the drawings, wherein.

The drawings illustrate the invention as applied to an in-line six cylinder diesel engine, but it should be understood that the principles of the invention may also be applied to other engine types, such as in-line four or eight cylinder engines, or V-type engines.

Figure 1:
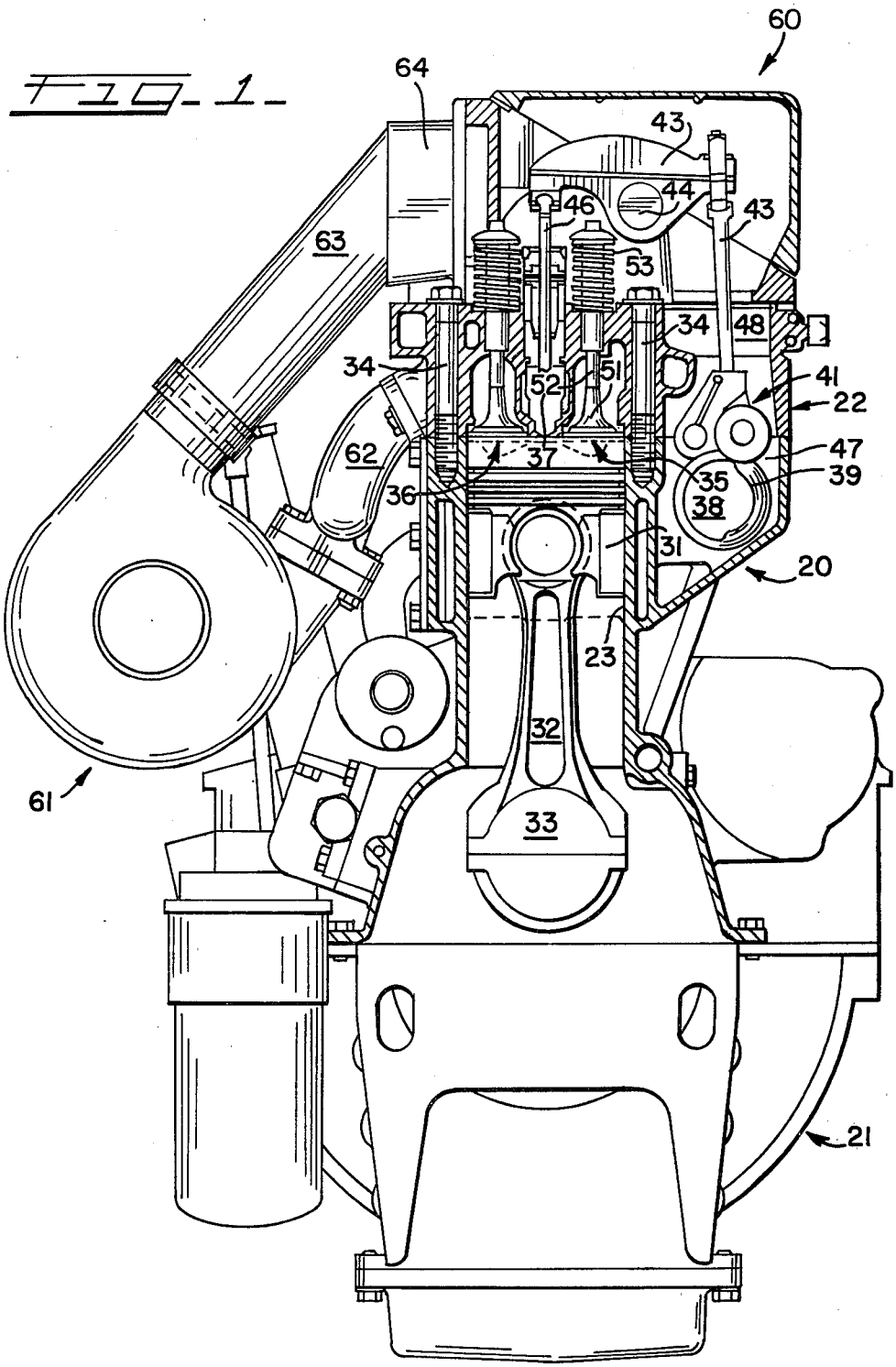
FIG. 1 is a view partially in section of an engine embodying the present invention.
Figure 2:
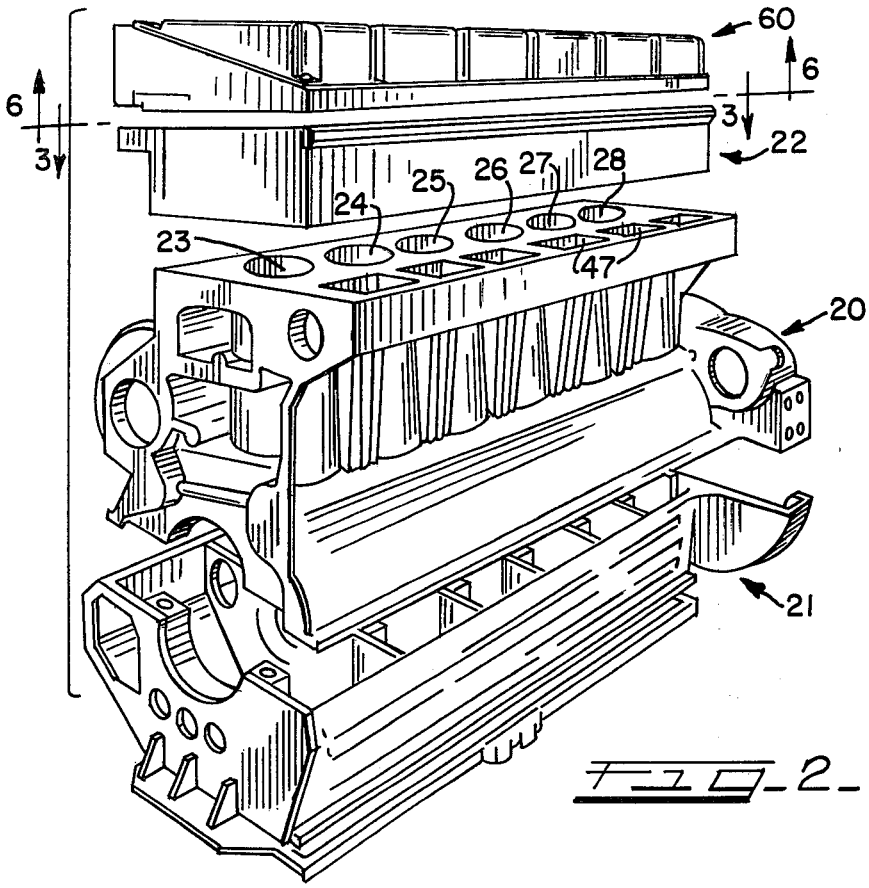
FIG. 2 is an exploded view of the engine shown in FIG. 1.

With reference to FIGS. 1 and 2, the engine includes a block 20, a crankcase and pan 21, a head 22, and other parts to be described hereinafter. Formed in the block 20 are six in-line cylinders 23 through 28, the No. 1 cylinder 23 being shown in section in FIG. 1. While the cylinders 23 through 28 are shown as being without liners, it should be understood that such liners may be provided in accordance with conventional practice. Reciprocating within each of the six cylinders 23 through 28 is a piston 31 fastened to the upper end of a connecting rod 32. The six connecting rods 32 are rotatably fastened to a crankshaft 33 which in turn is rotatably supported on the block of the engine 20 by main beaarings (not shown). The crankcase and pan 21 are secured to the underside of the block 20 and enclose various operating parts of the engine and form a sump or reservoir for the lubricant of the engine.

The head 22 of the engine is secured to the upper side of the block 20 by a plurality of bolts or studs 34 (FIG. 1) and the head supports, for each of the cylinders, a fuel injector 37, a pair of intake valves and a pair of exhaust valves. One intake valve 35 and one exhaust valve 36 are shown in FIG. 1, and the valve arrangement will be described in greater detail hereinafter. The injector 37 and the four valves of each cylinder are operated in synchronism with the other operating parts of the engine by a camshaft 38 that has a series of cams 39 mounted on it. For each cylinder, one cam operates the injector 37, another cam or cams operates the two intake valves and another cam or cams operates the two exhaust valves. For the injector 37, for example, a cam follower mechanism 41 follows the outer surface of the associated cam 39. A push tube 43 connects the follower mechanism 41 with one end of a rocker arm 43 that is pivotally supported on a rocker shaft 44. The other end of the rocker arm 43 engages a link 46 that extends between the rocker arm 43 and a plunger of the injector 37. During operation of the engine, toward the end of each compression stroke of the piston 31, the injector cam drives the push tube 43 upwardly, thereby forcing the link 46 and the injector plunger downwardly in order to inject fuel into the upper end of the cylinder 23 chamber.

Similar cam drives are provided for the intake and exhaust valves as previously mentioned, the intake valves being opened during the intake stroke of the piston 31 and the exhaust valves being opened during the exhaust stroke of the piston 31.

Figure 3:
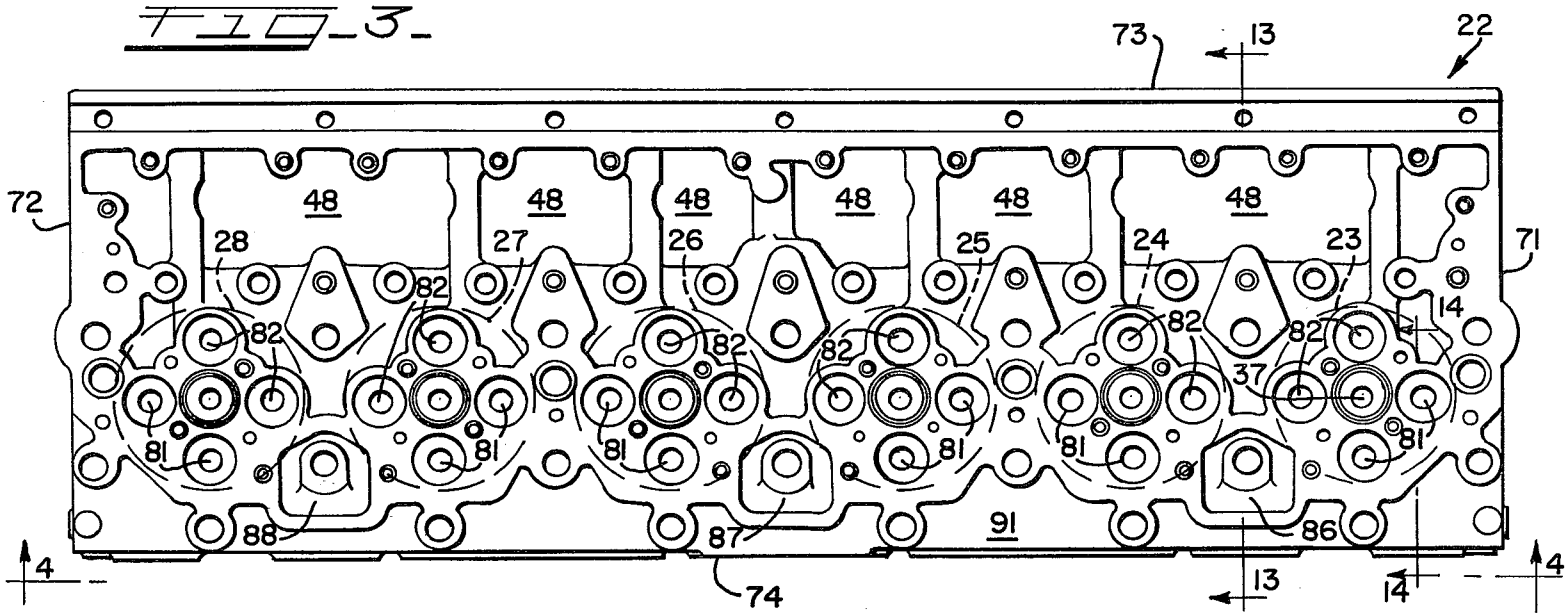
FIG. 3 is a plan view of the head, taken on the line 3—3 of FIG. 2.
Figure 4:
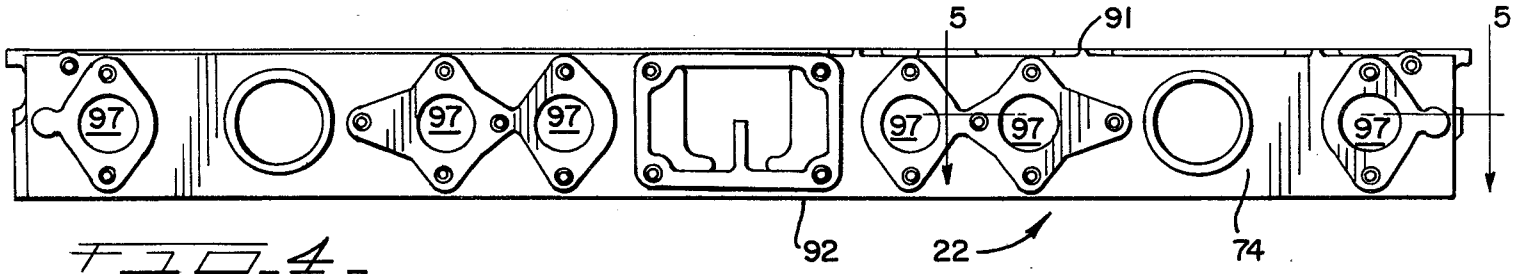
FIG. 4 is a side view of the head, taken on the line 4—4 of FIG. 3.

As shown in FIG. 1, the camshaft 38 is rotatably mounted near the upper end of the block 20 and the cam follower mechanisms are located in an opening 47 formed in the block 20 adjacent the associated cylinder, one opening 47 being provided for each of the cylinders as shown in FIG. 2. A plurality of openings 48 are also formed in the head 22 above the openings 47, the cam follower mechanisms and the push tubes extending through the head openings 48. FIG. 3 is a top plan view of the head 22 and shows the openings 48.

With reference to FIG. 1, each of the valves 35 and 36 is mounted in an intake or exhaust port formed in the lower surface of the head 22, and each valve includes a valve part 51 secured to the lower end of a valve stem 52. A valve return spring 53 encircles the stem 52 and is mounted between the upper end of the valve stem 52 and the upper surface of the head 22, the springs 53 normally urging the valves upwardly to their closed positions. However, at the appropriate times in the cycle of the engine, the cam driven mechanisms force the valve stems 52 and the valve heads 51 downwardly to open the ports, as is well known to those skilled in the art.

Intake air and exhaust passages are formed in the head 22 and in a rocker housing 60 as will be described in more detail hereinafter, and a turbocharger unit 61 is provided to supply the intake air, the turbocharger 61 being driven by the exhaust gases of the engine. The turbocharger may be generally conventional in design and includes a turbine part that receives exhaust gases through an exhaust manifold formed by a plurality of ducts 62 connected between the head 22 and the turbine 61. The turbocharger 61 further includes a compressor part that supplies intake air under pressure to the engine cylinders, the compressor output being connected by a duct 63 to the adjacent side of the rocker housing 60. An aftercooler having a conventional design may be provided in a part 64 fastened to the side of the housing 60 or in a separate housing (not shown) between the duct 63 and the part 64.

It will be noted from FIG. 1 that the turbocharger unit 61 is mounted on one side of the engine and that the exhaust and intake ducts 62 and 63 connect with the head 22 and with the rocker housing 60 on the same side of the engine, and this is an important feature of the present invention as will be discussed in more detail hereinafter.

Figure 5:
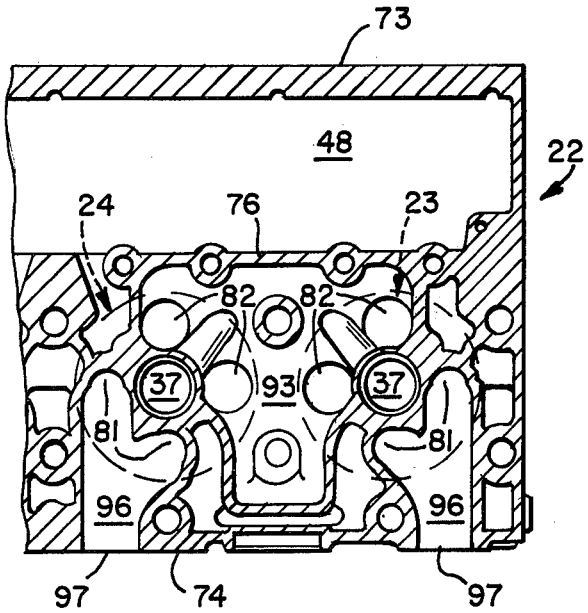
FIG. 5 is a fragmentary enlarged sectional view taken on the line 5—5 of FIG. 4.

FIGS. 3 to 5, 13 and 14 illustrate the construction of the head 22 in greater detail. The head 22 normally is a cast member and includes two end walls 71 and 72 (FIGS. 3 and 4), and two outer side walls 73 and 74, the four walls 71 through 74 forming a generally rectangular configuration as shown in FIG. 3. The head further includes upper and lower walls 91 and 92 and, as shown in FIG. 5, an inner wall 76 that extends between the two end walls 71 and 72. The spaces between the outer wall 73 and the inner wall 76 form the openings 47 for the cam followers 41 and for the push tubes 43.

Figure 13:
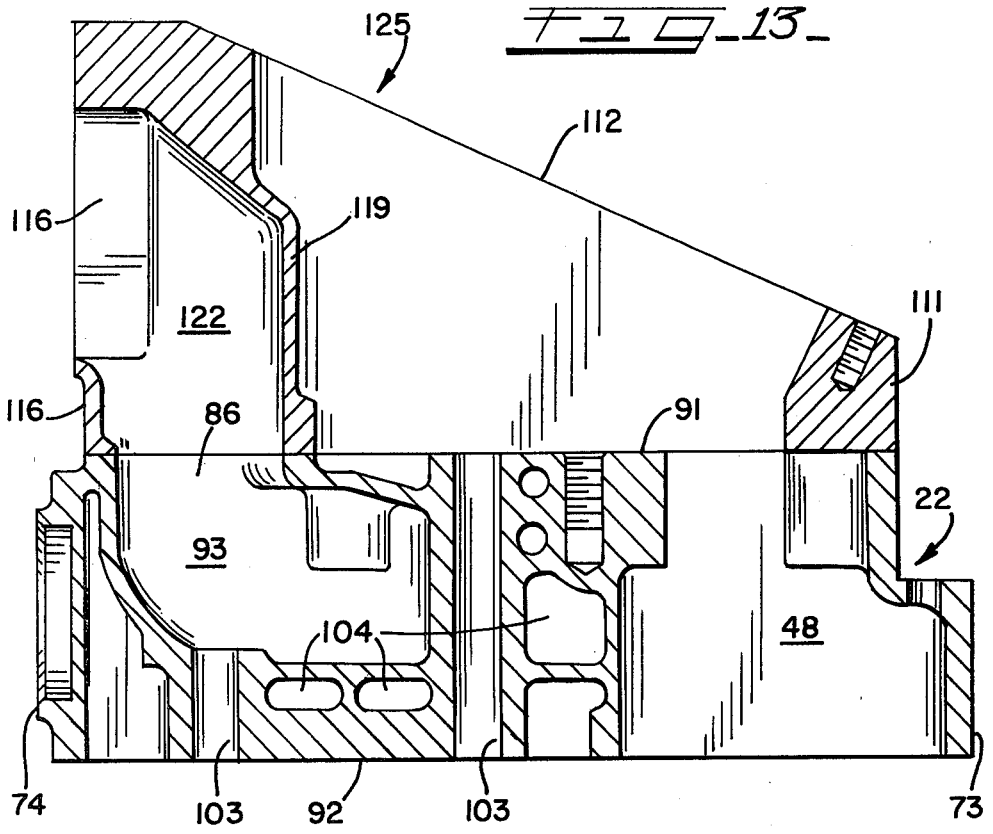
FIG. 13 is an enlarged sectional view taken on the line 13—13 of FIG. 3, showing the head and the rocker housing.
Figure 14:
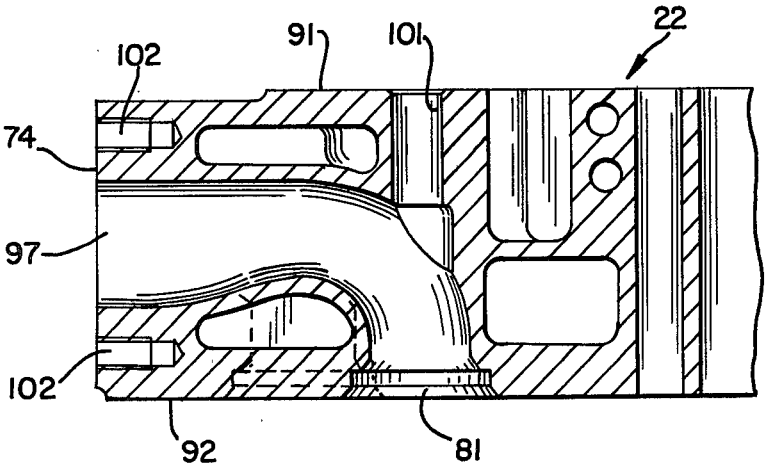
FIG. 14 is an enlarged sectional view taken on the line 14—14 of FIG. 3.

The arrangement of the intake and the exhaust ports and the injectors for the cylinders is best illustrated in FIGS. 3 and 5. For each cylinder, indicated in dashed lines, the associated injector 37 is secured in the head 22 on the axial centerline of the cylinder. The lower end of the injector extends into the cylinder or combustion chamber as shown in FIG. 1 and as is well known to those skilled in the art. For each cylinder there is also provided in the head 22 two exhaust ports 81 and two intake ports 82, the four ports 81 and 82 being spaced at 90° intervals around the injector and the axis or centerline of the cylinder. The valves 35 and 36 are, of course, mounted in the ports. For each of the cylinders, the centers of one of the ports 81 and one of the ports 82 are located in a vertical plane extending parallel to the side wall 73 and 74 and passing through the cylinder axis. The other two of the ports of each cylinder are in a vertical plane extending perpendicular to the first mentioned plane and passing through the cylinder axis. The port 82 of each cylinder which is closest to the side wall 73 is an intake port whereas the port 81 which is most closely adjacent the other side wall 74 is an exhaust port. The two cylinders 23 and 24 form a pair, the cylinders 25 and 26 form another pair, and the two cylinders 27 and 28 form still another pair, and the intake ports of each of the pairs of cylinders receive intake air through a common intake opening. The most closely adjacent ports of the pair of cylinders 23 and 24 are intake ports 82 and are on opposite sides of an intake opening 86 formed in the upper wall 91 of the head 22. Similarly, the most closely adjacent intake ports 82 of the pair of cylinders 25 and 26 are on opposite sides of an intake opening 87, and the most closely adjacent intake ports 82 of the pair of cylinders 27 and 28 are on opposite sides of an intake opening 88. Connecting the openings 86, 87 and 88 with the intake ports 82 are three separate intake air passages or chambers 93 formed within the head 22 between the upper and lower walls 91 and 92 (FIGS. 5 and 13). The chamber or intake passage 93 for the pair of cylinders 23 and 24, for example, extends from closely adjacent the outer side wall 74 to the inner wall 76. As best shown in FIG. 5, the chamber 93 opens up in a fan-shape from the associated opening 86 and extends over or includes the areas adjacent the four intake ports 82 of the pair of cylinders 23 and 24 and around the adjacent sides of the injectors 37 of the two cylinders 23 and 24. The chamber 93 thus overlies approximately one-half the area of each of the cylinders 23 and 24 and is separated from the injectors by a thin wall.

While pairs of cylinders receive intake air from common passages, the two exhaust ports 81 of the cylinders are connected by separate passages 96 (FIGS. 5 and 14) to exhaust openings 97 formed in the side wall 74 of the block 22. Each of the passages 96 extends around the associated ports 81, and it curves upwardly and toward the side wall 74. As previously mentioned and as shown in FIG. 1, the exhaust manifold is formed by a plurality of ducts which separate the exhaust gases in accordance with well known pulse turbine techniques. With specific reference to FIG. 14, a vertical hole 101 is formed through the head 22 above each exhaust port 81 and the stem of the associated valve 36 extends through the hole 101. Threaded holes 102 are formed in the side 74 of the head 22 for use in bolting the exhaust manifold ducts 62 to the side 74 of the head.

With reference to FIG. 13, the air intake passage or chamber 93 for the pair of cylinders 23 and 24 communicates with the opening 86 and curves downwardly and away from the side wall 74. The head 22 includes internal walls having holes 103 formed in them for securing the head 22, using bolts, to the upper surface of the block 20, and internal cavities 104, and the intake air chamber 93 extends around these internal walls.

The engine further includes the previously mentioned rocker housing 60 which encloses the rocker arms and has intake air passages formed in it for conducting the intake air from the intake manifold 64 to the openings 86, 87 and 88 in the head. With specific reference to FIGS. 1, 2 and 13, the rocker housing 60 includes a housing part 125 and a cover part 126. The part 125 is secured to the head 22 and is formed by a generally rectangular outer wall having substantially the same outer dimensions as the outer walls of the head. The side 110 of the housing wall is adjacent to the intake manifold 64 has a greater vertical height than the opposite side wall 111, and the upper surface of the housing part 125 slants downwardly from the wall 110 to the wall 111, the upper surface being indicated by the numeral 112. The lower surface 113 of the housing part 125 is generally horizontal and open as shown in FIG. 13.

Figures 6, 7, 8, 9:
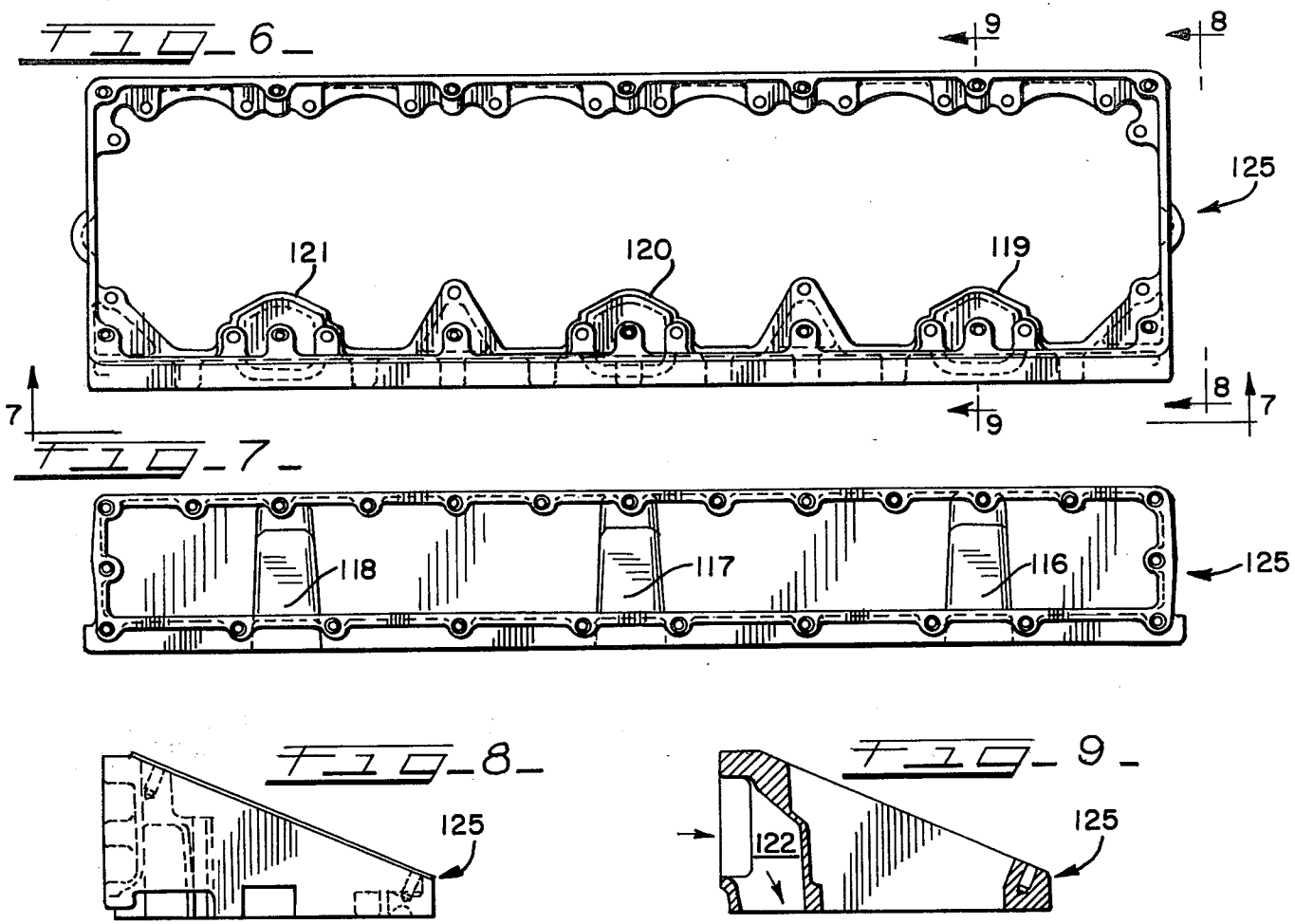
FIG. 6 is a view of the rocker housing, taken on the line 6—6 of FIG. 2.
FIG. 7 is a view taken on the line 7—7 of FIG. 6.
FIG. 8 is a view taken on the line 8—8 of FIG. 6.
FIG. 9 is a sectional view taken on the line 9—9 of FIG. 6.
Figure 10:
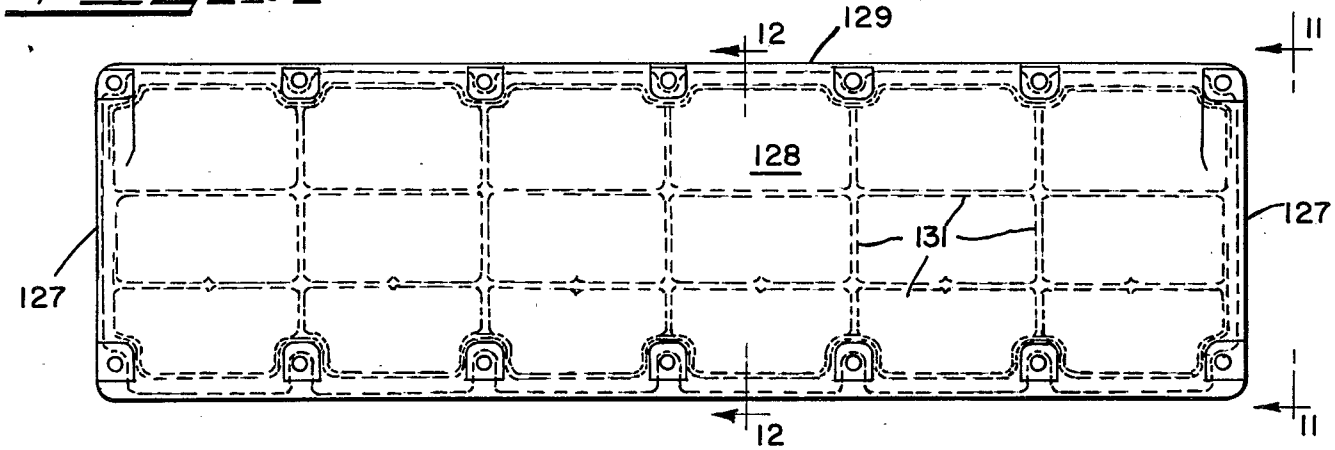
FIG. 10 is a view of a cover of the rocker housing.

With reference to FIGS. 7 and 13, three intake air openings 116, 117 and 118 are formed in the side wall 110, these three openings 116 through 118 being adjacent the openings 86, 87 and 88, respectively. Internal walls 119, 120 and 121 (FIGS. 6 and 13) are formed as part of the housing part 125 and from passages 122 which lead from the openings 116 to 118 to the openings 86 to 88. As best shown in FIG. 13, each passage 122 curves from the associated opening in the wall 110 inwardly and downwardly to the associated opening 86, 87 or 88. The intake air manifold 64 extends across and is secured to the side 110 of the rocker housing part 125 and encloses the three openings 116, 117 and 118, and consequently intake air flows from the ducts 63, through the three passages 122, into the three chambers 93, and to the air intake ports 82 of the six cylinders.

Figure 12:
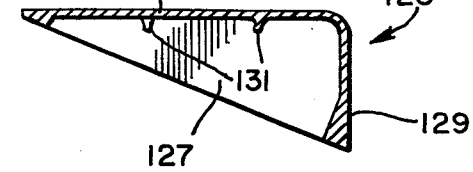
FIG. 12 is a sectional view taken on the line 12—12 of FIG. 10.
Figure 11:
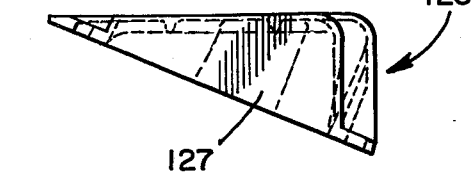
FIG. 11 is a view taken on the line 11—11 of FIG. 10.

As is best shown in FIG. 13, the space between the outer wall 111 and the internal walls 119 is open and forms an enclosure for the rocker arms and for the upper ends of the valves and the injectors. The cover part 126 is normally bolted to the upper side of the housing part 125. As shown in FIGS. 1, 11 and 12, the rocker cover 126 is right angular in cross-section and when attached to the upper side of the housing part, completely encloses and covers the rocker arms. The rocker cover 126 includes end walls 127 in addition to the upper and side walls 128 and 129, and a number of internal reinforcing ribs 131. The construction of the rocker housing 60 in two parts is advantageous because it enables access to the rocker arm mechanisms and to the valves and the injectors without necessitating the complete removal of the rocker housing and disconnection of the housing from the intake manifold.

It will be apparent from the foregoing that an improved and novel engine construction has been provided. The turbocharger unit 61 is located on one side of the engine and the intake and exhaust manifolds are also located entirely on the same side of the engine. Such an arrangement makes it unnecessary to provide a long duct leading from the compressor of the turbocharger to the intake manifold which, in conventional engines, are located on opposite sides of the engine.

We claim:

1. An internal combustion engine comprising a block having at least one pair of engine cylinders formed therein, a head fastened to said block and having two air intake ports and two exhaust ports formed therein for each cylinder, said ports communicating with the associated cylinders, a turbocharger mounted on one side of said block and said head, said two air intake ports and said two exhaust ports of each cylinder being arranged at substantially 90° intervals around the cylinder axis, one of said exhaust ports being adjacent said one side, one of said intake ports being adjacent the opposite side of said head, and the remaining intake and exhaust ports being between said one intake and said one exhaust ports, an exhaust opening for each cylinder formed in said one side of said head, an exhaust passage for each cylinder formed in said head and communicating with said exhaust opening and exhaust ports of the associated cylinder, said head including an upper wall, a bottom wall, and internal walls between said upper and bottom walls, an intake opening formed in said upper wall of said head substantially between the cylinders of said pair of cylinders, said walls forming an enlarged intake air chamber in said head and communicating with said intake opening, said internal walls extending around said intake air ports of said pair of cylinders, said chamber extending to said bottom wall and including the areas adjacent said air intake ports of said pair of cylinders, the intake air flowing generally parallel to said cylinders out of said chamber and through said air ports, a rocker housing fastened to said upper wall of said head, an intake air passage formed in said rocker housing, an intake air duct connected to said turbocharger and to said housing on said one side of the engine which is adjacent the exhaust openings, said intake air passage of said rocker housing communicating with said intake air duct and with said intake opening of said head, and exhaust ducts on said one side and connecting said turbocharger with said exhaust openings.

2. An engine as in claim 1, wherein said air intake ports are relatively closely adjacent each other, and said intake opening is between said ports.

3. An engine as in claim 2, wherein said enlarged chamber extends across approximately one-half of the upper surfaces of the pair of cylinders and across said air intake ports.

4. An engine as in claim 2, wherein said exhaust passage of each cylinder is separate from the other exhaust passages.

5. An engine as in claim 1, wherein said rocker housing includes a housing part and a cover part, said housing part being attached to said head and to said intake air duct and having said intake air passage formed therein, said housing part having an open upper side, and said cover part being secured to said housing part and extending across said open upper side of said housing part.

6. Apparatus for an internal combustion engine including a block that has at least one pair of cylinders formed therein, said apparatus comprising intake and exhaust ducts on one side of said block, a head adapted to be secured to the block and form the upper side of said cylinders, said head having a bottom wall that is adapted to engage said block, an upper wall which is opposite to said bottom surface, internal walls between said upper and lower walls, and one side which is adjacent to said ducts, two intake air ports and two exhaust ports formed in said bottom wall of said head above each of said cylinders and angularly spaced around the axis of each cylinder, said intake air ports of each cylinder being spaced substantially 90° apart and one of said intake air ports being between said cylinders, said exhaust ports of each cylinder being spaced substantially 90° apart and one of said exhaust ports being adjacent said one side, said intake air ports for said pair of cylinders being adjacent each other, said walls forming an enlarged chamber in said head between said upper and bottom surfaces and between said pair of said cylinders and in air flow communication with said intake air ports of said pair of said cylinders, an air intake opening formed in the upper wall of said head above said chamber and connected to said chamber for receiving intake air, said internal walls extending around said intake air ports of said pair of cylinders, said chamber extending to said bottom wall and including the areas adjacent said air intake ports of said pair of cylinders, the intake air flowing generally parallel to said cylinders out of said chamber and through said air ports, and an exhaust passage formed in said head and connected to each pair of said exhaust ports, said chamber being between said exhaust passages, said intake and exhaust ducts being respectively connected to said air intake opening and to said exhaust passage.

7. Apparatus as in claim 6, wherein said air intake opening in the upper wall of said head is adjacent said one side.

8. Apparatus as in claim 6, and further including a turbocharger mounted adjacent said one side and connected to said intake and exhaust ducts.

9. Apparatus as in claim 6, and further including a rocker housing fastened to the upper wall of said head, and an intake air passage formed in said rocker housing and connected between said air intake opening and said intake duct.

10. Apparatus as in claim 6, wherein said chamber extends across approximately one-half of the upper surfaces of said pair of cylinders.

11. Apparatus as in claim 6, wherein said exhaust passage of each cylinder is separate from the exhaust passage of the other cylinder.

12. Apparatus as in claim 9, wherein said rocker housing includes a housing part and a cover part, said housing part being attached to said head and having said intake air passages formed therein, said housing part having an open upper side, and said cover part being secured to said housing part and extending across said open upper side of said housing part.

13. An engine as in claim 6, wherein said ports of each cylinder are arranged at generally 90° angular intervals, one of said exhaust ports being relatively close to said one side of said engine and one of said intake ports being relatively close to the opposite side of said engine, and the remaining intake and exhaust ports being intermediate said sides.

14. In an internal combustion engine including a block that has at least one pair of cylinders formed therein, each of said cylinders having an axis and said axes of said pair of cylinders lying on a centerline, the improvement comprising a head adapted to be secured to the block and forming the upper side of said cylinders, said head including an upper wall, a bottom wall, and internal walls between said upper and bottom walls, two intake air ports and two exhaust ports formed in said bottom wall of said head above each of said cylinders, one of said intake ports and one of said exhaust ports of each cylinder lying substantially on said centerline and the other of said intake ports and exhaust ports of each cylinder being angularly spaced approximately 90° from said one ports, an exhaust passage formed in said head for each cylinder, each of said exhaust passages extending from one side of said head to the two exhaust ports of the associated cylinder, said other exhaust port that is angularly spaced approximately 90° from said one exhaust port of each cylinder being the closest port to said one side, said walls forming an enlarged intake air chamber in said head generally between said pair of cylinders, said intake air passage communicating with said intake ports of both of said cylinders, said internal walls extending around said intake air ports of said pair of cylinders, said chamber extending to said bottom wall and including the areas adjacent said intake air ports of said pair of cylinders, the intake air flowing generally parallel to said cylinders out of said chamber and through said air ports.

15. Apparatus for an internal combustion engine including a block that has at least one pair of cylinders formed therein, each cylinder having an axis, and intake and exhaust ducts on one side of said block, said apparatus comprising a head adapted to be secured to the block and to form the upper side of said cylinders, said head having a bottom wall that is adapted to engage said block, an upper wall which is opposite to said bottom wall, internal walls between said upper and bottom walls, and one side which is adjacent to said ducts, two intake air ports and two exhaust ports formed in said bottom wall of said head above each of said cylinders and angularly spaced around the axis of each cylinder, said intake air ports of each cylinder being adjacent each other and one of said intake air ports being between said cylinders, said exhaust ports of each cylinder being adjacent each other and at least one of said exhaust ports being adjacent said one side, said upper and lower walls and said internal walls forming an enlarged chamber between said pair of said cylinders, said internal walls extending around said intake air ports of said pair of cylinders, said chamber extending to said bottom wall and including the areas adjacent and encompassing said intake air ports of said pair of said cylinders, an air intake opening formed in said upper wall of said head above said chamber and between said cylinders and connected to said chamber for conveying intake air to said chamber, the intake air flowing generally parallel to said axis out of said chamber and through said air ports, said chamber having a flow area that is substantially greater than the flow area of said air intake opening and said air ports, and a relatively short exhaust passage for each cylinder formed in said head and connected to each pair of said exhaust ports and extending to said one side, said chamber being between said exhaust passages, and said air intake opening and said exhaust passages being adapted to be connected to said intake and exhaust ducts respectively.

16. Apparatus as in claim 15, and further including a rocker housing fastened to the upper wall of said head, and an intake air passage formed in said rocker housing and connected between said air intake opening and said intake duct, said air passage in said rocker housing conveying intake air generally parallel to said axes into said chamber.

17. An engine as in claim 15, wherein said ports of each cylinder are arranged at generally 90° angular intervals, one of said exhaust ports being relatively close to said one side of said engine and one of said intake ports being relatively close to the opposite side of said engine, and the remaining intake and exhaust ports being intermediate said one intake port and said one exhaust port.

18. In an internal combustion engine including a block that has at least one pair of cylinders formed therein, each of said cylinders having an axis and said axes of said pair of cylinders lying on a centerline, the improvement comprising a head adapted to be secured to the block and forming the upper side of said cylinders, said head including an upper wall, a bottom wall and internal walls between said upper and bottom walls, two intake air ports and two exhaust ports formed in said bottom wall of said head above each of said cylinders, one of said intake ports and one of said exhaust ports of each cylinder lying substantially on said centerline and the other of said intake ports and exhaust ports of each cylinder being angularly spaced approximately 90° from said one ports, an exhaust passage formed in said head for each cylinder, each of said exhaust passages extending from one side of said head to the two exhaust ports of the associated cylinder, said other exhaust port that is angularly spaced approximately 90° from said one exhaust port of each cylinder being the closest port to said one side, said walls forming an enlarged intake air chamber in said head between said cylinders and extending above and being in flow communication with said air ports of both cylinders, and an intake air opening formed in said upper side between said exhaust passages and in flow communication with said intake air chamber, said chamber having a flow area that is substantially greater than the flow area of said intake air opening and said intake ports, said internal walls extending around said intake air ports of said pair of cylinders, said chamber extending to said bottom wall and including the areas adjacent said intake air ports of said pair of cylinders, the intake air flowing generally parallel to said cylinders out of said chamber and through said air ports.

* * * * *